US007473165B1

(12) United States Patent
Berryhill

(10) Patent No.: US 7,473,165 B1
(45) Date of Patent: Jan. 6, 2009

(54) VACUUM-ASSISTED SANDING BLOCK

(76) Inventor: Thomas Berryhill, 1990 NE. 23rd Ter., Jensen Beach, FL (US) 34957

( * ) Notice: Subject to any disclaimer, the term of this patent is extended or adjusted under 35 U.S.C. 154(b) by 0 days.

(21) Appl. No.: 11/750,576

(22) Filed: May 18, 2007

Related U.S. Application Data

(60) Provisional application No. 60/803,431, filed on May 30, 2006.

(51) Int. Cl.
*B24B 23/00* (2006.01)

(52) U.S. Cl. ..... 451/354; 451/451; 451/456

(58) Field of Classification Search ..... 451/354, 451/356, 357, 451, 456, 350
See application file for complete search history.

(56) References Cited

U.S. PATENT DOCUMENTS

| | | | | | |
|---|---|---|---|---|---|
| 2,499,933 | A | | 3/1950 | Smul | |
| 2,929,177 | A | | 3/1960 | Sheps | |
| 3,638,362 | A | | 2/1972 | Stoll | |
| 3,785,092 | A | | 1/1974 | Hutchins | |
| 3,824,689 | A | | 7/1974 | Hutchins | |
| 3,892,091 | A | | 7/1975 | Hutchins | |
| 3,932,963 | A | | 1/1976 | Hutchins | |
| 4,052,824 | A | | 10/1977 | Hutchins | |
| 4,058,936 | A | | 11/1977 | Marton | |
| 4,062,152 | A | * | 12/1977 | Mehrer | 451/344 |
| 4,071,981 | A | | 2/1978 | Champayne | |
| 4,091,576 | A | | 5/1978 | Hutchins | |
| 4,150,598 | A | * | 4/1979 | Berends et al. | 83/478 |
| 4,184,291 | A | | 1/1980 | Marton | |
| 4,287,685 | A | | 9/1981 | Marton | |
| 4,296,572 | A | | 10/1981 | Quintana | |
| 4,398,375 | A | | 8/1983 | Malyuk | |
| 4,549,371 | A | | 10/1985 | Hakoda | |
| 4,616,449 | A | | 10/1986 | Marton | |
| 4,671,019 | A | | 6/1987 | Hutchins | |
| 4,671,020 | A | | 6/1987 | Hutchins | |
| 4,759,155 | A | * | 7/1988 | Shaw | 451/524 |
| 4,839,995 | A | | 6/1989 | Hutchings | |
| 4,937,984 | A | * | 7/1990 | Taranto | 451/524 |
| 5,001,869 | A | | 3/1991 | Hutchins | |
| 5,007,206 | A | * | 4/1991 | Paterson | 451/344 |
| 5,022,190 | A | | 6/1991 | Hutchins | |
| 5,105,585 | A | | 4/1992 | Hampl et al. | |
| 5,283,988 | A | * | 2/1994 | Brown | 451/524 |
| 5,527,212 | A | * | 6/1996 | Bowen et al. | 451/456 |
| 5,582,541 | A | | 12/1996 | Hutchins | |
| 5,919,085 | A | | 7/1999 | Izumisawa | |
| 6,219,922 | B1 | * | 4/2001 | Campbell et al. | 30/124 |
| 6,413,157 | B1 | * | 7/2002 | Marton | 451/357 |
| 7,112,127 | B2 | * | 9/2006 | Watson et al. | 451/356 |
| 7,249,996 | B1 | * | 7/2007 | Volyar | 451/354 |

* cited by examiner

*Primary Examiner*—Timothy V Eley
(74) *Attorney, Agent, or Firm*—Ruden McClosky; James David Johnson

(57) ABSTRACT

A vacuum-assisted sanding block having a swiveling connection tube for connecting the dust removal channels of the sanding block top and bottom plates to a vacuum system. The manual sanding block also includes a plate system for suctioning away dust and other particulate matter created during the sanding process. This plate system includes a top plate for connecting the swiveling connection tube, a channeled bottom plate having apertures for suctioning away the sanding dust, and a center separator plate positioned securely between the top and bottom plates. The swiveling connection tube may also be used with mechanical sanders to permit easier maneuvering of the sander into corners.

17 Claims, 5 Drawing Sheets

VACUUM-ASSISTED SANDING BLOCK

BACKGROUND OF THE INVENTION

1. Field of the Invention

The invention relates to a vacuum-assisted sanding block to remove dust and other particles produced by the sanding process.

2. Description of Related Art

Conventional manual sanding blocks produce large quantities of dust and particulate debris as an unsightly, and sometimes dangerous, waste byproduct of the sanding process. Conventional mechanical sanding blocks and equipment that include dust removal components are often difficult to maneuver into corners and may include expensive parts. The current invention uses inexpensive parts to create a system for removing dust created during the sanding process using a manual sanding block. The invention also provides a device that permits both manual and mechanical sanding blocks having vacuum-assist features to be easily maneuvered within corners and at angles.

U.S. Pat. No. 5,919,085, issued to Izumisawa on Jul. 6, 1999, describes a power abrading tool having a dust abatement feature. The Izumisawa invention is a mechanical sander and does not include a swiveling elbow joint connection tube for connecting to a vacuum system.

U.S. Pat. No. 5,105,585, issued to Hampl et al., on Apr. 21, 1992, describes a dust emissions control mechanism for hand sanders comprising a suction manifold and a grooved sanding disk. The Hampl invention does not include a center separator plate or a swiveling elbow joint connection tube for connecting to a vacuum system.

U.S. Pat. No. 4,616,449, issued to Marton on Oct. 14, 1986, describes a suction housing for vacuum sanding devices comprising a suction plate and a backup pad. The '449 invention does not include top and bottom plates with a center separator plate disposed between them or a swiveling elbow joint connection tube for connecting to a vacuum system.

U.S. Pat. No. 4,549,371, issued to Hakoda on Oct. 29, 1985, describes a dust collecting apparatus for sanders, which does not include a center separator plate or the swiveling elbow joint connection tube described by the current invention.

U.S. Pat. No. 4,287,685, issued to Marton on Sep. 8, 1981, describes a pad assembly for a vacuum rotary sander. The '685 invention does not describe the swiveling elbow joint connection tube for connecting to a vacuum system.

U.S. Pat. No. 4,058,936, issued to Marton on Nov. 22, 1977, describes a vacuum sander that is mechanical and that does not include the swiveling elbow joint connection tube or center separator plate of the current invention.

U.S. Pat. No. 3,638,362, issued to Stoll on Feb. 1, 1972, describes a portable grinder apparatus that is also mechanical and that does not include the swiveling elbow joint connection tube or center separator plate having a central aperture as described in the current invention.

U.S. Pat. No. 2,499,933, issued to Smul on Mar. 7, 1950, describes a surface cleaning attachment that does not include any parts similar to those of the current invention.

SUMMARY OF THE INVENTION

The invention relates to a vacuum-assisted, manual sanding block comprising a handle block for grasping, a top plate, a bottom plate, and a center separator plate disposed securely between said top and bottom plates. The manual sanding block further includes a swiveling connection tube for connecting an aperture and charnel suctioning system of the manual sanding block to a vacuum system. Any commercially available vacuum system may be connected to the manual sanding block to provide the required vacuum force.

The ergonomically-shaped handle block includes a top surface that is gripped by the user while sanding an object and a bottom surface. A top surface of the top plate is securely attached to the bottom surface of said handle block. The top plate includes an aperture penetrating the top and bottom surfaces of said top plate and a channel on the bottom surface connected at one end to the aperture and having a terminal end terminating at the center of said bottom surface of said top plate. The swiveling connection tube is connected to the aperture on the top surface of the top plate within a mounting recess in the handle block that exposes the top surface of said top plate.

A top surface of the center separator plate is securely attached to the bottom surface of the top plate. The center separator plate includes a centrally located aperture that extends entirely through said separator plate. A bottom surface of the center separator plate is securely attached to a top surface of the bottom plate. The central aperture of the center separator plate ensures that the suctioning force of the connected vacuum system is evenly distributed through all of a plurality of apertures penetrating through the bottom plate.

A top surface of the bottom plate includes a plurality of channels that are interconnected with each other and with the plurality of apertures that penetrate the top surface and exit through a bottom surface of said bottom plate. In the preferred embodiment, the top surface of the bottom plate includes two longitudinal channels intersected in the middle by a transverse channel. The aperture of the center separator plate is disposed preferably over the point of intersection between the longitudinal channel of the bottom plate and the middle transverse channel, thereby providing maximum suctioning force to all of said bottom plate apertures. A piece of sand paper is attached to the bottom surface of said bottom plate. Said sand paper includes apertures corresponding in location so as to be aligned with the apertures through the bottom plate.

The swiveling connection tube of the manual sanding block includes a free end and a threaded end that is connected to the aperture of the top plate where said top plate aperture is exposed within the mounting recess of the handle block. Said swiveling connection tube may also be used with circular mechanical sanders to provide easier maneuverability of the mechanical sander in corners and at angles.

An object of this invention is to provide an inexpensive and effective device for suctioning away dust and particulate matter produced by sanding the surface of an object.

Another object of this invention is to provide an inexpensive and effective device for maneuvering a vacuum-assisted, manual sanding block into corners and at angles during use in the sanding process.

Still another object of this invention is to provide an inexpensive and effective device for maneuvering a vacuum-assisted, circular mechanical sander into corners and at angles during use in the sanding process.

In accordance with these and other objects which will become apparent hereinafter, the instant invention will now be described with particular reference to the accompanying drawings.

DETAILED DESCRIPTION

Figure 1A:
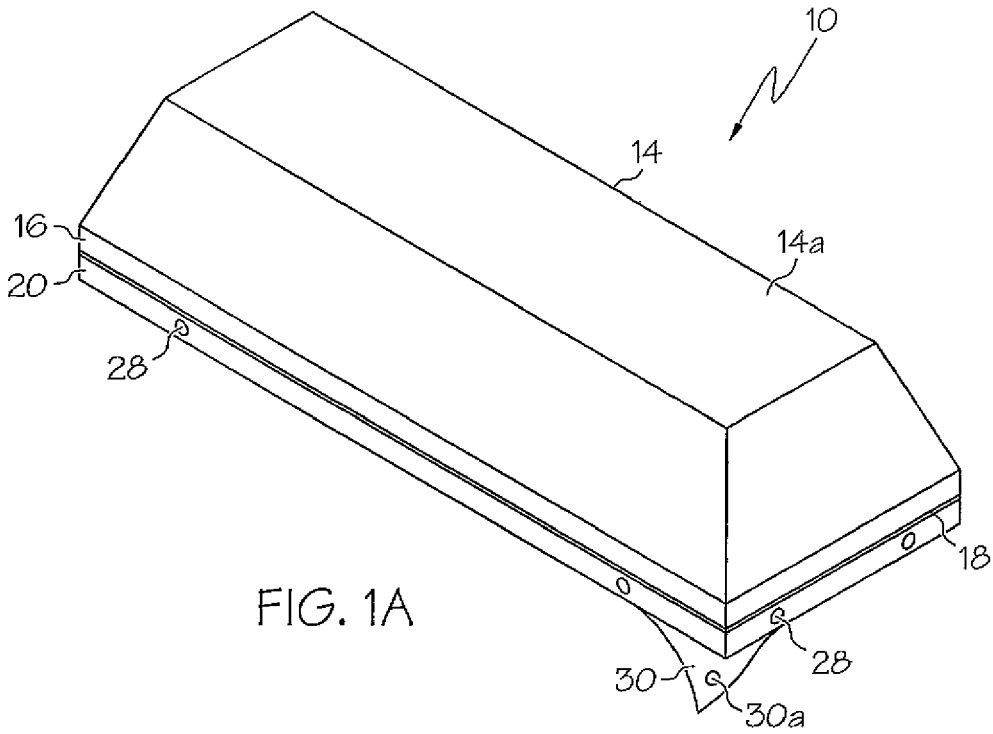
FIG. 1A shows a front perspective view of the invention used with a manual sanding block.
Figure 1B:
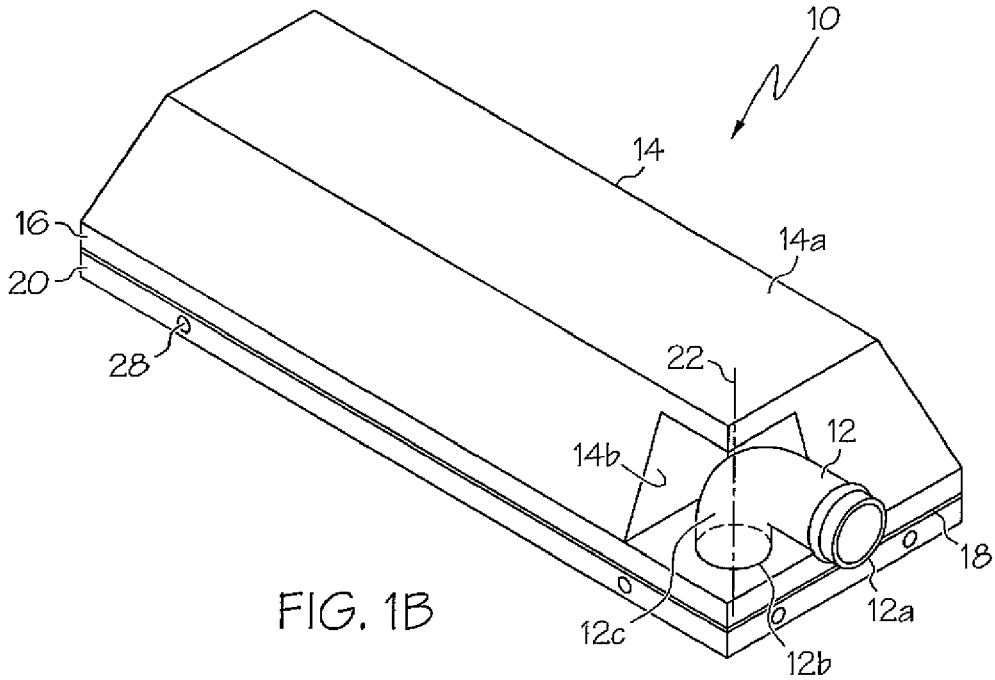
FIG. 1B shows a rear perspective view of the invention used with a manual sanding block and one example of the location for placement of the swiveling elbow joint connection tube.

As illustrated in FIGS. 1A and 1B, the invention 10 relates to a vacuum-assisted manual sanding block 10 that includes components for suctioning away dust and particulate matter produced by the sanding process as well as a swiveling, vacuum system connection tube 12 for easier maneuvering of the sanding block 10 in corners and at angles. The manual sanding block 10 comprises a handle block 14, a top plate 16, a center separator plate 18, a bottom plate 20, and the swiveling vacuum connection tube 12. The handle block 14 may be of any geometric shape, but is preferably of an ergonomic design permitting easy grasping by the user during use in the sanding process. One such ergonomic design for the handle block 14 is illustrated in FIGS. 1A and 1B. The handle block 14 includes a top surface 14*a* for grasping and a bottom surface (not shown in the drawings) for attachment of the top plate 16. Preferably, said handle block 14 is constructed from a rigid, durable, lightweight material. In one embodiment of the invention, the handle block 14 is constructed from a lightweight, high density foam. Plastics, wood, metals, metal alloys, and composite materials may also be used to create the handle block 14.

In an alternate embodiment of the invention, the handle block 14 may include one or more recesses within the bottom surface to enhance the suctioning force of the vacuum system as it is applied to the manual sanding block 10.

Figure 3A:
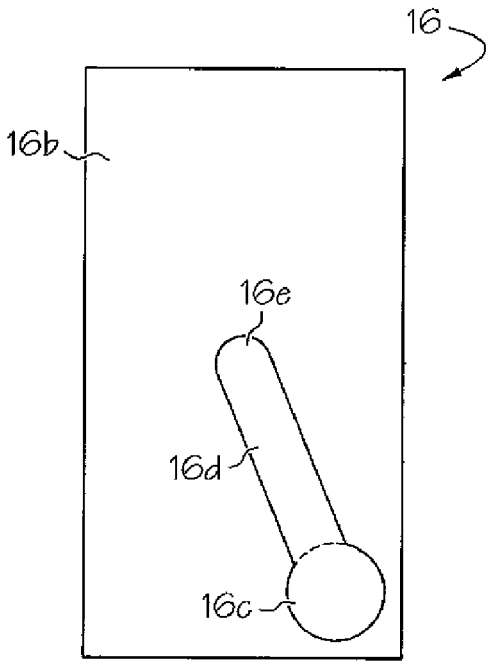
FIG. 3A shows a bottom plan view of the top plate.
Figure 3B:
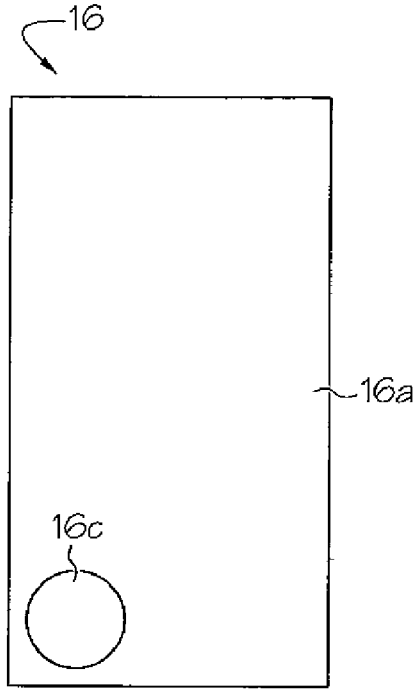
FIG. 3B shows a top plan view of the top plate.
Figure 6:
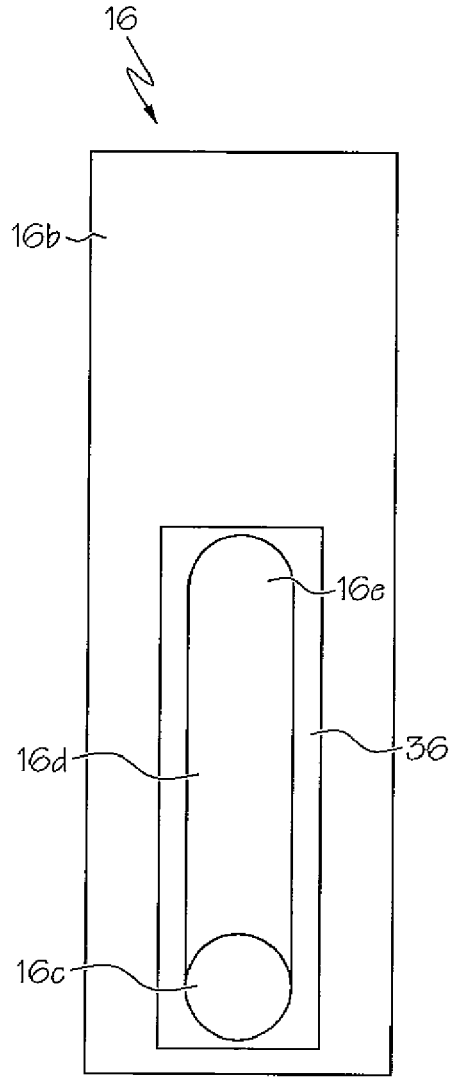
FIG. 6 shows a bottom plan view of the preferred embodiment of the top plate.

The top plate 16 is securely attached to the bottom surface of said handle block 14. Preferably, the top plate 16 is attached to the handle block 14 by an adhesive or by heat molding and becomes irremovable once attached thereto. As illustrated in FIGS. 3A, 3B, and 6, said top plate 16 includes a top surface 16*a* and a bottom surface 16*b*. The top plate 16 further includes an aperture 16*c* extending entirely through the top surface 16*a* and exiting the bottom surface 16*b* of said top plate. In the preferred embodiment of the invention, the bottom surface 16*b* of the top plate 16 includes a channel 16*d* in communication with said aperture 16*c*. Said channel 16*d* includes a terminal end 16*e* terminating on or near the center of said bottom surface 16*b* of the top plate 16. Preferably, the bottom surface 16*b* of the top plate 16 further comprises a countersunk recess 36 (shown in FIG. 6) that surrounds and overlaps the deeper channel 16*d*. The recess 36 is sized and shaped to receive the insertion of the center separator plate 18 which fits inside said recess flush with the bottom surface 16*b*.

Figure 4:
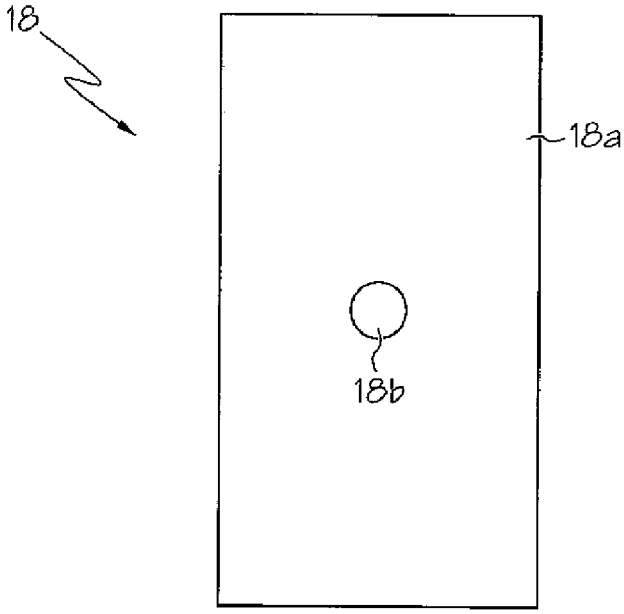
FIG. 4 shows a top plan view of the center separator plate, with the bottom plan view of said plate being identical in appearance.
Figure 7:
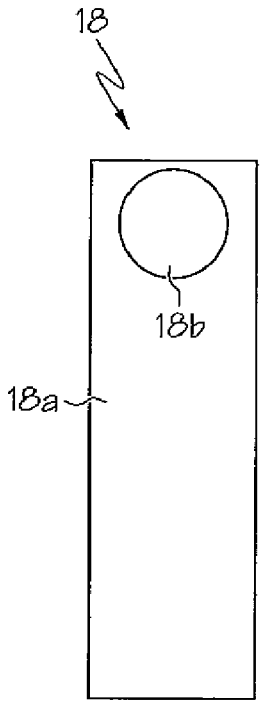
FIG. 7 shows a top plan view of the preferred embodiment of the center separator plate, with the bottom plan view of said plate being identical in appearance.

A top surface 18*a* of the center separator plate 18 is securely attached to the bottom surface 16*b* of said top plate 16. Said center separator plate 18 includes the top surface 18*a*, a bottom surface (not shown in the drawings but preferably identical to the top surface 18*a*), and an aperture 18*b* that is in communication with the aperture 16*c* of the top plate 16. In preferred embodiment of the sanding block 10, the center separator plate 18 is constructed in a smaller size and shape than that of the top plate 16 so that said center separator plate fits within the countersunk recess 36 of said top plate as illustrated in FIG. 7. In this preferred embodiment, the aperture 18*b* of said center separator plate 18 is located through one end of said plate 18 so as to allow alignment of said aperture 18*b* with terminal end 16*e* of channel 16*d* of the top plate 16. In alternate embodiments, the center separator plate 18 may be constructed in the same size and shape as the top plate 16 with the aperture 18*b* being located through the center of said separator plate as shown in FIG. 4. In the preferred embodiment, the center separator plate 18 is constructed from a thin, semi-rigid material that is irremovably disposed between the top plate 16 and the bottom plate 20 of the sanding block 10. Said center separator plate 18 may be attached to the top plate 16 by an adhesive or by heat molding. The aperture 18*b* of said center separator plate 18 communicates with the aperture 16*c* of the top plate 16 by direct alignment with said top plate aperture 16*c* or, in the preferred embodiment, by communication with the terminal end 16*e* of the channel 16*d* of the top plate 16.

Figure 5A:
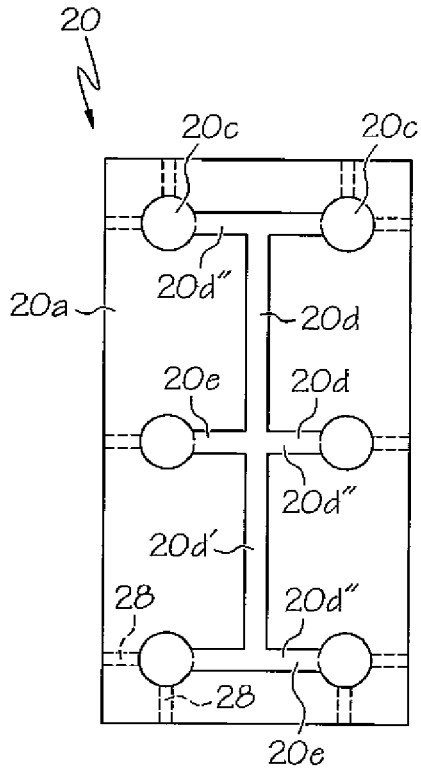
FIG. 5A shows a top plan view of the bottom plate.
Figure 5B:
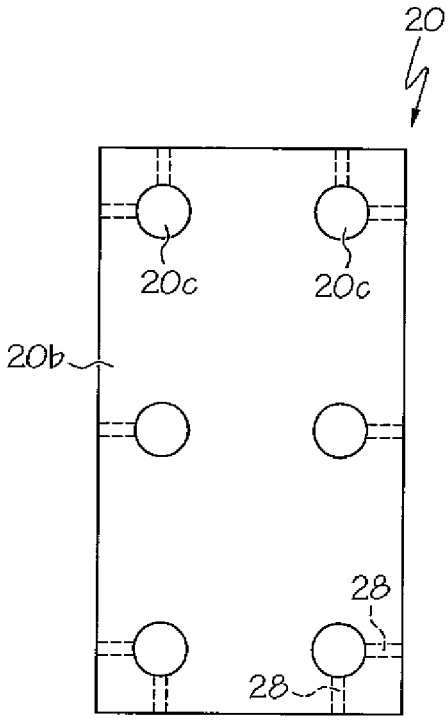
FIG. 5B shows a bottom plan view of the bottom plate.
Figure 8:
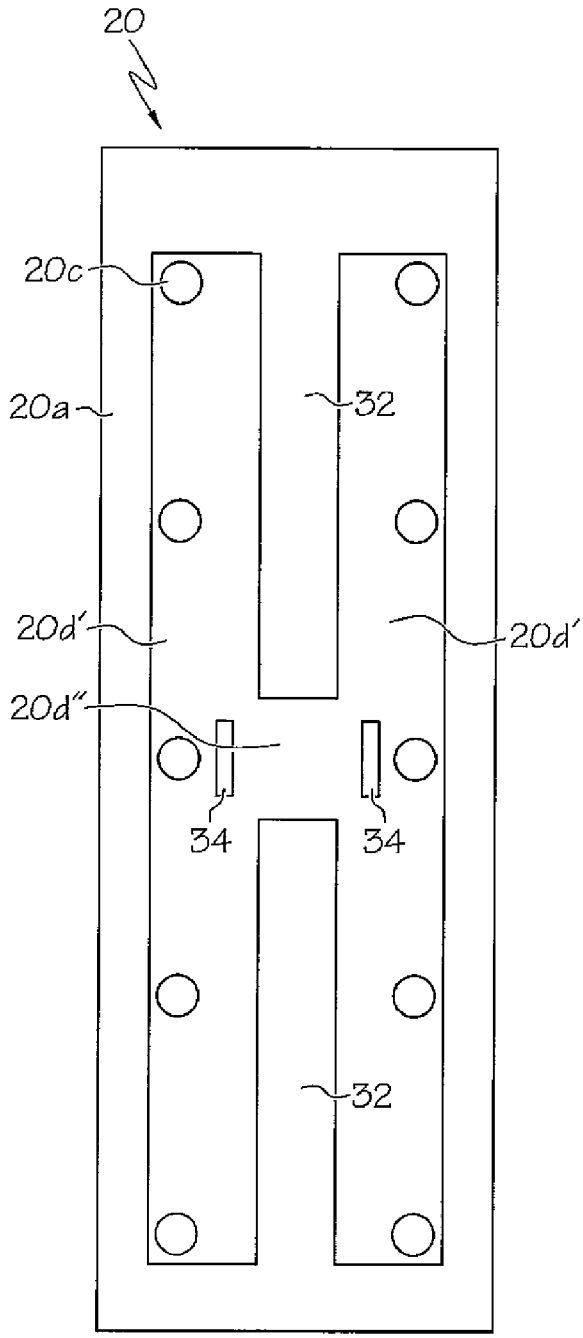
FIG. 8 shows a top plan view of the preferred embodiment of the bottom plate.

The bottom plate 20, illustrated in FIGS. 5A, 5B, and 8, is securely attached to the bottom surface of the center separator plate 18. Said bottom plate 20 includes a top surface 20*a*, a bottom surface 20*b*, and a plurality of apertures 20*c* extending through the top surface 20*a* and exiting the bottom surface 20*b* of said bottom plate. The top surface 20*a* of the bottom plate 20 preferably is attached to the bottom surface of the center separator plate 18 by an adhesive or by heat molding. In the preferred embodiment of the invention, the bottom plate 20 becomes irremovable once attached to the center separator plate 18. The top surface 20*a* of said bottom plate 20 includes a plurality of interconnected channels 20*d* connecting to the plurality of apertures 20*c* extending through the bottom plate. The channels 20*d* are shallow grooves cut or molded into the top surface 20*a* of the bottom plate 20. In the preferred embodiment, shown in FIG. 8, the top surface 20*a* of the bottom plate 20 includes two longitudinal channels 20*d*' and a central transverse channel 20*d*" that connects said longitudinal channels. In this embodiment, the longitudinal channels 20*d*' are separated by one or more wall elements 32 that act as support structures to prevent the top plate 16 and center separator plate 18 from collapsing into the cavity formed by channels 20*d*' and 20*d*" when the user is applying pressure downward on the unit 10 during use. As illustrated in FIG. 8, the preferred embodiment further comprises two block elements 34 that distribute the suction force or draw more evenly among the apertures 20*c* so that the most centrally-located apertures (which are nearest to and partially blocked by the block elements 34) do not create the greatest suction force thereby reducing the suction force of the remaining apertures 20*c*. Said block elements also serve as support structures to prevent the top plate 16 and center separator plate 18 from collapsing into the channels 20*d* as pressure is applied downward on the unit 10 by the user during use.

An alternate arrangement of the channels 20*d*, shown in FIG. 5B, has one longitudinal channel 20*d*' and three evenly spaced transverse channels 20*d*'. Each transverse channel 20*d*' in this embodiment includes two opposing terminal ends 20*e* and each terminal end 20*e* connects to one of the apertures 20*c* (preferably, six apertures in total) that extends through said bottom plate 20. Other channel configurations and other numbers of channels and apertures are contemplated by the invention as long as each aperture 20*c* is in communication with a channel 20*d*.

When connected together, the central aperture 18*b* of the center separator plate 18 is positioned over the longitudinal channel 20*d*' or over the intersection of the longitudinal and middle transverse channels 20*d*' and 20*d*" of the bottom plate 20. This arrangement permits maximum vacuum force to be applied through each of the apertures 20*c* of the bottom plate 20 so that said vacuum force is distributed evenly through each of said apertures 20*c* to most effectively suction sanding dust from the surface of the object being sanded.

The bottom plate 20 may also include a plurality of side apertures 28 that extend through the sides of the bottom plate and exit into the nearest aperture 20*c*. The side apertures 28 are drilled through the sides of the bottom plate 20 to permit the inflow of air into the apertures 20*c* and the channels 20*d* that is necessary to provide a vacuum force of sufficient force to effectively remove sanding dust and particulate matter created by the sanding process.

A sheet of sand paper or sanding material 30 is securely fastened to the bottom surface 20*b* of the bottom plate 20. Said sheet of sand paper includes a plurality of apertures 30*a* (shown in FIG. 1) that corresponds in number and in location with those of the apertures 20*c* of the bottom plate 20. The apertures of the sand paper are aligned with the apertures 20*c* exiting the bottom surface 20*b* of the bottom plate 20, and the sheet of sand paper is attached to said bottom surface by an adhesive backing. In another embodiment of the invention, the sheet of sand paper may include either hook fasteners or loop fasteners for attachment to the bottom plate 20 of the sanding block 10. In that embodiment, the bottom surface 20*b* of the bottom plate 20 may be fitted with an appropriate layer or patches of hook fasteners or loop fasteners for engaging the fasteners of the sand paper. Adhesives or patches of hook and loop fasteners are conventionally used to attach sand paper to the bottom of a sanding block, and thus, are not illustrated in the drawings.

The top plate 16, center separator plate 18, and bottom plate 20 are preferably constructed from a rigid, durable, lightweight material. Suitable construction materials include but are not limited to polymer foams, including lightweight, high density foam, plastics, wood, metals, metal alloys, and composite materials. The same construction material may be used to create said top plate 16, said center separator plate 18, and said bottom plate 20, or each of these components may be constructed from different materials. These components may also be constructed from the same or from different materials as that used in the construction of the handle block 14.

FIG. 1B illustrates the swiveling connection tube 12 of the sanding block 10 for connecting said manual sanding block 10 to a vacuum system (not shown in the drawings). Preferably, the handle block 14 includes an appropriately sized and shaped mounting recess 14*b* that exposes the aperture 16*c* through the top surface 16*a* of the top plate 16. The swiveling connection tube 12 is securely attached to the aperture 16*c* within this recess 14*b*. Said mounting recess 14*b* may be positioned in one corner of the block handle 14 of the manual sanding block 10 or may be located along one side of the handle block 14. However, the mounting recess 14*b* must be located to expose the aperture 16*c* of the top plate 16 to which said swiveling connected tube 12 is attached. The swiveling connection tube 12 comprises a rigid, elbow-shaped tube 12 with one free end 12*a* and one threaded end 12*b* that is screwed into the aperture 16*c* of the top plate 16, said aperture 16*c* also being threaded. Alternatively, the swiveling connection tube 12 may be constructed with conventional features that permit the end 12*b* of said tube 12 to snap into aperture 16*c* rather than including threading to be screwed into said aperture. The free end 12*a* of said swiveling connection tube 12 is the point of attachment for a vacuum system hose or tube (not shown in the drawings). The swiveling connection tube pivots at least 90 degrees or more around an axis 22 extending through the center of a vertical segment 12*c* of said tube 12. Most preferably, said swiveling connection tube pivots 180 degrees around said axis 22. The pivoting action, or swiveling motion, of the connection tube 12 permits the user to maneuver the sanding block 10 more easily into corners and at angles.

An adapter may be used to attach vacuum system hoses of larger or smaller diameters than the swiveling connection tube to said connection tube 12. A flexible connection hose that swivels may be used in place of the more rigid swiveling connection tube.

Figure 2A:
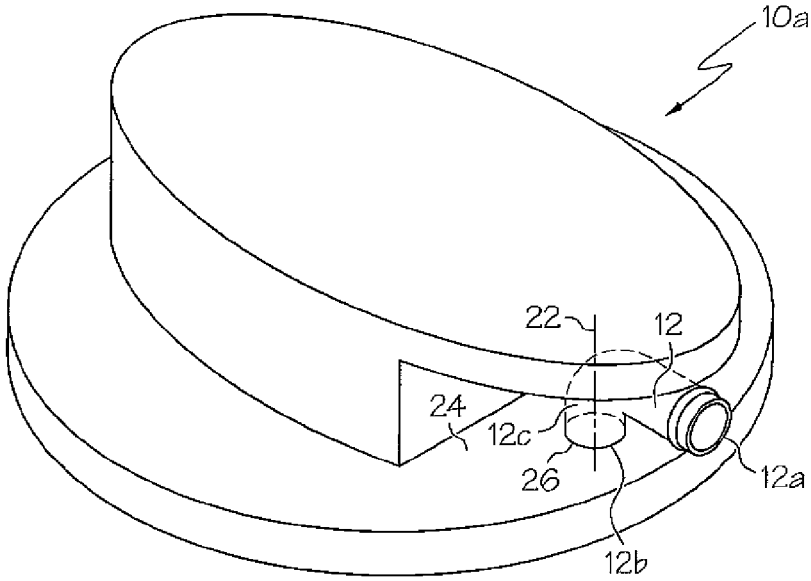
FIG. 2A shows a rear perspective view of the invention used with a circular mechanical sander.
Figure 2B:
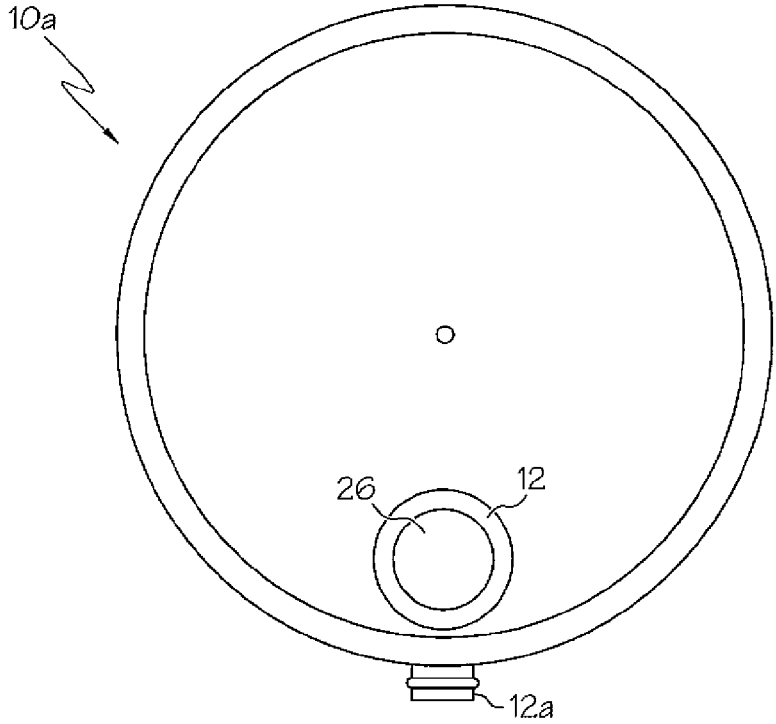
FIG. 2B shows a bottom plan view of the invention used with a circular mechanical sander.

In another embodiment of the invention (shown in FIGS. 2A and 2B), a sanding block 10*a* of a circular mechanical sander includes a mounting recess or mounting surface 24 having an aperture 26 to which a swiveling connection tube 12 is attached for connecting said mechanical sanding block 10*a* to a vacuum system. As with the manual sanding block 10, the swiveling connection tube 12, when used with a mechanical sander 10*a*, permits the user to maneuver the sanding block 10*a* more easily into corners and at angles.

Although the handle block 14, top plate 16, bottom plate 20, and center separator plate 18 of the above-described vacuum-assisted, manual sanding block 10 are permanently connected in the described sequence, other configurations of the sanding block may also be constructed. In one embodiment of the invention, the handle block, top plate, bottom plate, and center separator plate may be constructed as one suctioning unit by molding or by the use of an adhesive.

In another embodiment of the invention, one or more of the handle block, top plate, bottom plate, and center separator plate may be constructed as two or more units that include fasteners for securely engaging each constructed unit with the appropriate surface of the appropriate corresponding unit in the manner and sequence described in the specification above. The units may each be constructed as separate single-piece components using an adhesive or by molding.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A vacuum-assisted sanding block, comprising:

a handle block for grasping;

a top plate securely attached to a bottom surface of said handle block and having an aperture extending through a top surface and a bottom surface of said top plate, wherein said top plate further comprises a channel on the bottom surface that is in communication with said aperture of the top plate;

a center separator plate securely attached to the bottom surface of the top plate and having an aperture in communication with the aperture through said bottom surface of the top plate;

a bottom plate securely attached to a bottom surface of the center separator plate and having a plurality of apertures interconnected by channels, said channels being in communication with the aperture of the center separator plate; and a swiveling connection tube for interconnecting between a vacuum system and the aperture through the top surface of said top plate.

2. The sanding block of claim 1, wherein sand paper is attached to a bottom surface of the bottom plate.

3. The sanding block of claim 2, wherein said sand paper includes apertures that align with the plurality of apertures, wherein the plurality of apertures exit the bottom surface of the bottom plate.

4. The sanding clock of claim 1, wherein the plurality of apertures of the bottom plate extend entirely through a top surface and a bottom surface of said bottom plate.

5. The sanding block of claim 1 wherein the handle block is constructed from a rigid, durable, lightweight material in an ergonomic design that allows easy grasping by a user during use of said sanding block.

6. The sanding block of claim 1, wherein said handle block comprises:

a top surface for grasping; and said bottom surface for attachment of the top plate.

7. The sanding block of claim 1, wherein said handle block is constructed from lightweight, high-density foam.

8. The sanding block of claim 1, wherein the handle block, top plate, center separator plate, and bottom plate are attached securely together by an adhesive or by heat molding.

9. The sanding block of claim 1, wherein the bottom plate comprises:

a top surface;

a bottom surface; and the plurality of apertures which extend entirely through said top surface and said bottom surface of said bottom plate.

10. The sanding block of claim 9, wherein the plurality of apertures of the bottom plate are connected by a plurality of interconnected channels cut into the top surface of said bottom plate.

11. The sanding block of claim 10, wherein said plurality of interconnected channels comprises:

two longitudinal channels into which the plurality of apertures exit; and a central transverse channel that connects the two longitudinal channels.

12. The sanding block of claim 10, wherein the top surface of the bottom plate includes a means for supporting to prevent the top plate and center separator plate from collapsing into the channels as pressure is applied downward on the handle block during use.

13. The sanding block of claim 10, wherein said plurality of interconnected channels comprises:

a longitudinal channel; and a plurality of transverse channels in communication with the longitudinal channel.

14. The sanding block of claim 13, wherein each transverse channel includes two opposing terminal ends and each of said terminal ends connects to one of the apertures that extend through said bottom plate.

15. The sanding block of claim 1, wherein said handle block, said top plate, said center separator plate, and said bottom plate comprise a permanently-connected, unitary, single-piece unit.

16. The sanding block of claim 1, wherein the bottom surface of said top plate includes a recess into which the center separator plate is fitted so as to be flush with said bottom surface of said top plate.

17. The sanding block of claim 1, wherein said top plate, said center separator plate, and said bottom plate are substantially planar.

* * * * *